US006772862B2

(12) United States Patent
Friedli

(10) Patent No.: US 6,772,862 B2
(45) Date of Patent: Aug. 10, 2004

(54) TRANSPORTATION SYSTEM OPERATION USING IDENTIFICATION CODES

(75) Inventor: Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 62 days.

(21) Appl. No.: 10/246,134

(22) Filed: Sep. 19, 2002

(65) Prior Publication Data

US 2003/0051947 A1 Mar. 20, 2003

(30) Foreign Application Priority Data

Sep. 20, 2001 (EP) ..... 01810910

(51) Int. Cl.[7] ..... B66B 1/28

(52) U.S. Cl. ..... 187/247; 187/382; 187/392; 187/393

(58) Field of Search ..... 187/391, 392, 187/393, 380, 382, 247, 248, 284, 286, 387, 388; 340/5.6, 7.1, 5.61, 5.7, 5.8

(56) References Cited

U.S. PATENT DOCUMENTS

| | | | | | |
|---|---|---|---|---|---|
| 5,159,163 | A | * | 10/1992 | Bahjat et al. | 187/381 |
| 5,241,141 | A | * | 8/1993 | Cominelli | 187/295 |
| 5,257,176 | A | | 10/1993 | Uetani | |
| 5,290,976 | A | * | 3/1994 | Bahjat et al. | 187/295 |
| 5,689,094 | A | | 11/1997 | Friedli et al. | |
| 5,689,708 | A | * | 11/1997 | Regnier et al. | 709/229 |
| 6,109,396 | A | | 8/2000 | Sirag et al. | |
| 6,202,799 | B1 | | 3/2001 | Drop | |
| 6,209,685 | B1 | | 4/2001 | Zaharia et al. | |
| 2001/0013123 | A1 | * | 8/2001 | Freeman et al. | 725/34 |
| 2002/0129995 | A1 | * | 9/2002 | Friedli et al. | 187/392 |
| 2003/0043001 | A1 | * | 3/2003 | Gerstenkorn | 340/5.61 |
| 2003/0098776 | A1 | * | 5/2003 | Friedli | 340/5.8 |
| 2003/0121728 | A1 | * | 7/2003 | Friedli | 187/247 |

FOREIGN PATENT DOCUMENTS

| | | | | |
|---|---|---|---|---|
| EP | 0 699 617 | | 3/1996 | |
| EP | 1288870 | A2 * | 3/2003 | G07C/9/00 |
| EP | 1308409 | A1 * | 5/2003 | B66B/1/34 |
| JP | 04313581 | A * | 11/1992 | B66B/3/00 |
| WO | WO 00/75062 | | 12/2000 | |
| WO | WO 01/02279 | | 1/2001 | |

* cited by examiner

*Primary Examiner*—Jonathan Salata
(74) *Attorney, Agent, or Firm*—MacMillan Sobanski & Todd, LLC

(57) ABSTRACT

A system for transporting persons/goods in elevator installations and/or on escalators includes a control device and a computer program product for commanding the system. At least one person/goods is recognized by at least one recognition device via at least one identification code which recognized code is passed to the control device. For each recognized identification code at least one user profile has been stored and is used as a transportation profile to command operation of the system. At least two of the user profiles are linked to form a shared transportation profile to command operation of the system.

13 Claims, 3 Drawing Sheets

| A | | | | F | | R |
|---|---|---|---|---|---|---|
| A1 | A1' | A1" | | F1 | | R1 |
| A2 | A2' | A2" | | F2 | | R2 |
| A3 | A3' | A3" | X | F3 | = | R3 |
| A4 | A4' | A4" | | F4 | | R4 |
| A5 | A5' | A5" | | F5 | | R5 |

TRANSPORTATION SYSTEM OPERATION USING IDENTIFICATION CODES

BACKGROUND OF THE INVENTION

The present invention relates to a system for transportation of persons/goods in elevator installations and/or on escalators, a method of operating such a system, a control device and a computer program product for commanding such a system.

Systems for the transportation of persons/goods in elevator installations and/or on escalators enable identification of persons/goods for transportation, as well as transportation controlled by this identification. European Patent Application EP 0 699 617, which represents the prior state of the art for the invention, discloses a device for commanding an elevator installation as means of transportation in which the elevator installation is commanded contactlessly by a person via an identification transmitter and a recognition device. The identification transmitter is borne by the person and transmits an identification code to the recognition device which is fixed in location. The recognition device recognizes the identification code and passes it on to a processing unit. The processing unit assigns to this recognized passed-on identification code a predefined desired travel destination, and transmits a corresponding control signal to the elevator installation. The elevator installation then transports the person identified in this manner automatically and without intervention of the person to the person's destination.

It is desirable for the individual characteristics and needs of persons/goods for transportation in elevator installations and/or on escalators to be better recognized. Furthermore, it is desirable to better respect interactions between persons/goods for transportation. Finally, it is desirable better to recognize collective characteristics and needs of persons/goods for transportation.

SUMMARY OF THE INVENTION

The purpose of the present invention is to provide a system for transporting persons/goods in elevator installations and/or on escalators, a method of operating such a system, a control device and a computer program product for commanding such a system, which fulfill the aforesaid desires.

The essence of the present invention is to transport persons/goods by elevator installations and/or on escalators in such manner that the transported persons, and/or persons requiring the goods to be transported, are satisfied in an outstanding manner. This is achieved by extensive configuration of a system for transportation of persons/goods.

"Extensive configuration" means that in a first step at least one user profile is created for persons/goods to be transported. There are different profiles:

- a spatial user profile, or zone profile, where a spatial access authorization of the user in zones is defined; and/or
- a temporal user profile, or period profile, where temporal rights of the user are defined in periods; and/or
- a person/goods-specific user profile, or individual profile, where individual information about the user such as user name, office/floor, building/office number, telephone number, birthday, sex, weight, etc. are defined, and where also preferences of the user such as the type of news the user does or does not wish to receive in the means of transport, the type of music the user does or does not wish to receive in the means of transport, are defined; and/or
- a group-specific user profile, or group profile, where information regarding priority when transporting the users, etc. is defined; and/or
- a security-relevant user profile, or security profile, where information about security aspects of the user, such as a hazard/risk assessment (Does the person/goods item present a hazard? And if so, for which other persons/goods to be transported? Is the person/goods item exposed to hazards? And if so, what steps should be taken if an emergency occurs?) are defined.

These components, zone profile, period profile, individual profile, group profile, and security profile, of a user profile can be combined with each other in any manner.

"Extensive configuration" means further, that in a second step either one user profile is used as transportation profile, or at least two user profiles of persons/goods to be transported are linked together and thereby result in at least one situatively adapted transportation profile. Advantageously, user profiles of persons/goods to be transported are set in relation to at least one logical gate to produce a transportation profile.

In this manner, travel plans for the persons/goods to be transported can be easily and quickly assembled. At least one person/goods item to be transported is recognized by at least one recognition device via at least one identification code. This recognized identification code is passed on to at least one control device. Either at least one user profile of at least one person/goods item to be transported is made ready for each recognized identification code, or user profiles of at least two persons/items of goods to be transported are linked to form a transportation profile. At least one transportation means such as an elevator installation or an escalator or a door is commanded by the control device according to this transportation profile.

This extensive configuration of user profiles corresponds to a large extent with what is known from computer-aided network technology, where the rights of users in a network are administered and assigned by an administrator. Surprisingly, an application of this network administration has so far not been realized in systems for transportation of persons/goods.

There are several reasons for this:

- One reason is that the wishes and needs of users of transportation means have so far not been clearly articulated, and/or the wishes and needs of the users of means of transportation have so far not been captured in an extensive configuration.
- Another reason is that satisfaction of the wishes and needs of the users according to the present invention has not been technically possible, for example because no standard has established itself for the necessary identification codes and means of recognition, and/or because the computers and/or computer program products necessary for this purpose were insufficiently powerful and/or too expensive.
- Finally, prejudice of experts in the field had to be overcome. The machine industry, which manufactures means of transportation, clung to its traditional technical areas and had restricted itself to producing and operating mechanically stable and inexpensive means of transportation. Until now, the machine industry had not set itself the task of the present invention. Until now, the machine industry had more or less ignored the wishes and needs of the users of means of transportation. Until now, the machine industry had also hardly, or not at all, concerned itself with the new technologies necessary for the solution of the invention such as identification codes and means of recognition, or with computers and computer program products.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
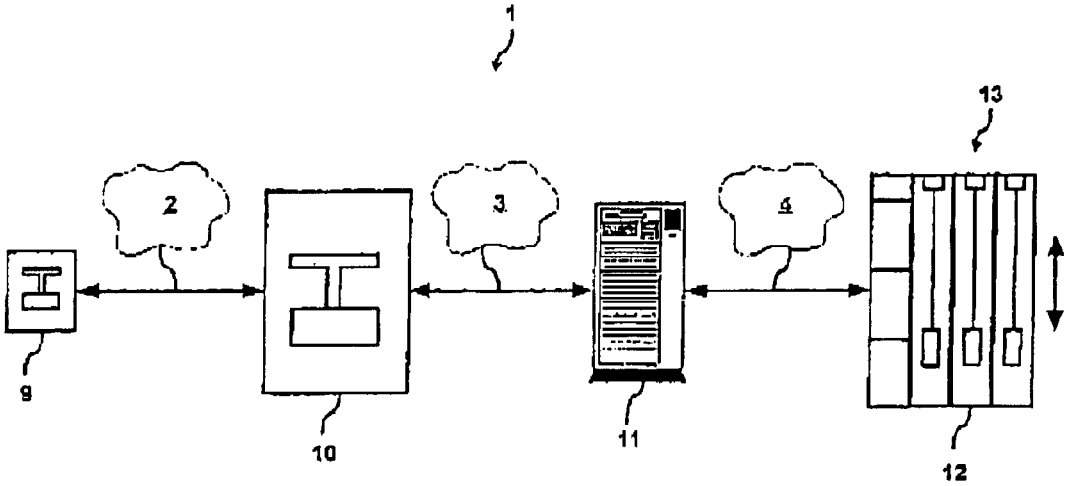
FIG. 1 is a diagram representing the principle of part of the system for transportation of persons/goods according to the present invention.

FIG. 1 shows a diagram representing the principle of a part of an exemplary embodiment of a system 1 for the transportation of persons/goods in elevator installations and/or on escalators according to the present invention. The system 1 comprises at least one identification code 2, at least one recognition device 10, at least one control device 11, and at least one means of transportation 12 such as an elevator installation or an escalator.

The identification code 2 is recognized by the recognition device 10 and serves to identify uniquely a person or an item of goods.

For example, an identification transmitter 9 communicates with the recognition device 10 by transmitting a signal including the identification code 2. Advantageously, the identification transmitter 9 is mobile and borne by the person or item of goods, whereas the recognition device 10 is mounted in a fixed location, for example near the transportation means 12.

The identification transmitter 9, is, for example, a transponder with transponder antenna and transmitter electronics. The transmitter electronics of the identification transmitter 9 have, for example, a transmitter and receiver unit and a memory containing at least one item of information. This information comprises, for example, information about the identification transmitter standard, according to which the identification transmitter is readable and writable, and/or a serial number of the identification transmitter with which the identification transmitter is uniquely identifiable, and/or at least one identification code 2 according to which the bearer of the identification transmitter is uniquely identifiable.

For example, the identification transmitter 9 is provided with an operating voltage by induction from an electromagnetic field. Preferably, the recognition device 10 radiates such an electromagnetic field. The recognition device 10 has a correspondingly constructed transmission and reception antenna and an electronic reading and writing unit. For example, the reading and writing unit of the recognition device 10 has a memory for a recognition protocol and a processor to execute the recognition protocol.

The identification transmitter 9 and the recognition device 10 communicate bidirectionally, which is represented diagrammatically in FIG. 1 by a double-headed arrow. For example, the identification transmitter 9 is carried into a transmission and reception area of the recognition device 10 and receives with the transponder antenna an inquiry signal of the recognition device 10 and thereupon emits as a response signal to the recognition device 10 the identification code 2 stored in the memory of the transponder. Recognition protocols have many variations. For example, communication between the identification transmitter 9 and the recognition device 10 is encrypted, and the identification transmitter 9 may also demand a password from the recognition device 10 before the former is readable and/or writable. For example, the identification code 2 of the recognition device 10 is recognized with a recognition protocol. The recognition protocol can be proprietary, but it can also be standardized in industrial standards. Self-evidently, with knowledge of the present invention, a person skilled in the art can realize unlimited variations of this embodiment of an identification transmitter and/or a recognition device intended for it. Thus, other identification transmitters, for example such as use light as the basis for contactless communication with a recognition device, can also be used. The presented embodiment of an identification transmitter and a recognition device intended for it respectively is exemplary and not restrictive for the scope of application and/or protection of the invention. In particular, the invention is not restricted to contactlessly communicating identification transmitters. Thus, identification transmitters in the form of magnetic cards, electronic chips, etc, which communicate with a recognition device via at least one intermediary contact, can also be used. Also, the recognition device need not be mounted near to the means of transportation; mobile recognition devices are also possible.

As an alternative to the use of an identification transmitter communicating with a recognition device, it is possible to enter an identification code mechanically, for example via a keypad of a recognition device. Such a keypad is operated by the user for example by hand, and is for example a landing keypad situated on a floor near to the elevator installation, or a car keypad situated in an elevator car. It is also possible for an identification code to be entered acoustically, for example via a microphone or recognition device. For example, the microphone receives a frequency and recognizes this frequency, or a user speaks into the microphone, which speech input is recognized by the recognition device. Finally, it is possible for an individual identification code of a user, such as a fingerprint, an iris, a facial contour, a magnetic field, etc. to be recognized with a recognition device.

The control device 11 is, for example, connected by wire or radio to at least one recognition device 10. The communication between the recognition device 10 and the control device 11 is bidirectional and represented diagrammatically in FIG. 1 as a double-headed arrow. The recognition device 10 emits, as output signal, for example a recognized identification code 3 to the control device 11, whereas the control device 11 for example makes inquiries to the recognition device 10.

Figure 2:
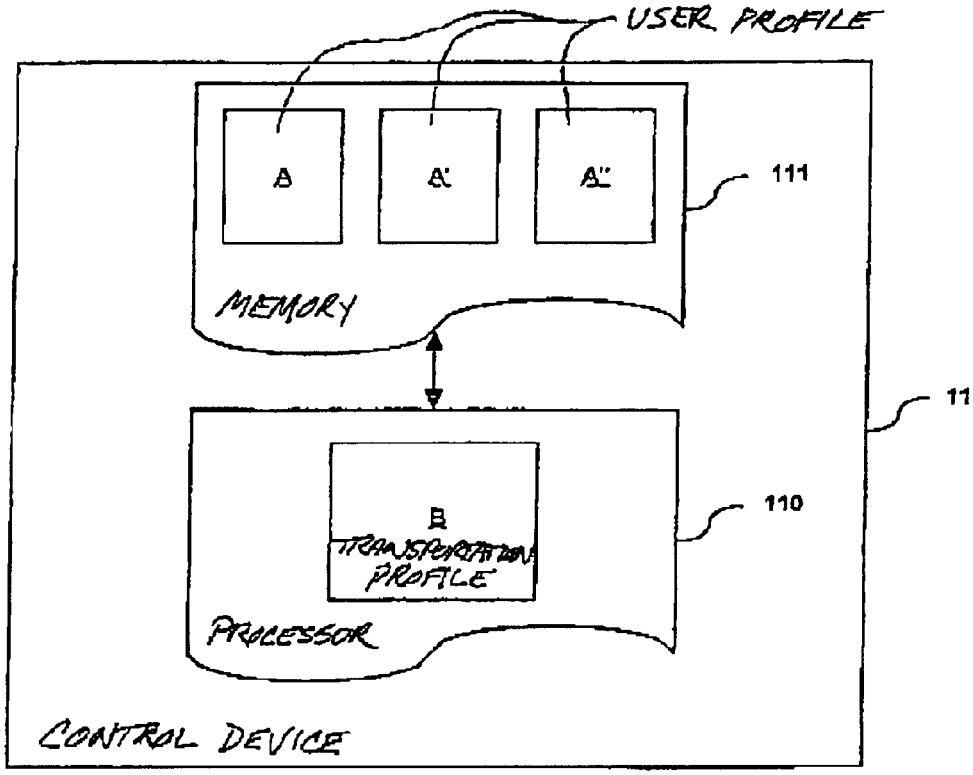
FIG. 2 is a block diagram of the linking of a user profile to a transportation profile of the system for transporting persons/goods shown in FIG. 1.

FIG. 2 shows a block diagram of a link from a user profile A (A', A") to at least one transportation profile B. The control device 11 is, for example, a commercially available personal computer or a workstation. The control device 11 has a processor 110 for linking the user profiles A, A', A" to the transportation profile B. The processor 110 can have a non-volatile memory. The control device 11 has access to a memory 111 with the user profiles A, A', A". For example, the memory 111 with the user profiles A, A', A" is arranged in the control device 11. For each recognized identification code 3, at least one of the user profiles A, A', A" from the memory 111 is made ready and in the processor 110, advantageously according to at least one logical gate such as "AND", "OR", "NOT", etc., linked to form the transportation profile B. Two or more of the user profiles A, A', A" can be linked to form a shared transportation profile.

The arrangement and linking of the user profiles A, A', A" is carried out by at least one computer program product. The computer program product serves to command the system 1 to transport persons/goods. The computer program product is, for example, written in a well-known and proven computer language. For example, the computer program product is implemented in any computer intended for its execution, for example the computer program product is stored in a memory and is loaded into a processor for execution of the computer program product. For example, this computer is the control device 11, for example the computer program product is stored in the memory 111 of the control device 11, and, for example, the computer program product is loaded into the processor 110 of the control device 11. The computer program product is in known manner storable, reproducible, and updatable. Self-evidently, with knowledge of the present invention a person skilled in the art can realize unlimited variations of this embodiment of a computer program product. Thus, for the purpose of the invention, it is not necessary for the computer program to be implemented in the control device. It is entirely possible to implement the computer program product in any separate computer intended for execution of the computer program product, and to communicate the result of the execution of the computer program product to the control device. For example, the computer program product is implemented in a remote server. For this purpose the control device can be connected with such a computer by, for example, wire or radio, or by, for example, the Internet.

Advantageously, the control device 11 has a bus processor. The bus processor serves, for example, for communication between the processor 110 of the control device 11 and the means of transportation 12. The control device 11 commands the means of transportation 12 according to the transportation profile B via at least one control signal 4. Self-evidently, with knowledge of the present invention a person skilled in the art can realize unlimited variations of a control device. The embodiment of a control device shown is exemplary and not restrictive for the scope of application and/or protection of the invention. For example, the control device can be constructed as an insert, set-top box, etc. for a recognition device. It is also possible to arrange the memory with user profiles in a remote server, and to communicate user profiles to the control device by, for example, wire or radio, or by, for example, the Internet. This makes it possible to provide a secure and/or central remote server for all user profiles. It is also possible to communicate user profiles from a memory of a remote server to the control device with or without being requested by the control device.

The means of transportation 12 is, for example, an elevator installation with one or more elevators that transport persons/goods in, for example, the transportation direction of the double-headed arrow according to FIG. 1. For example, the elevator installation according to FIG. 1 has three elevators that have entrance/exit points on various floors of a building 13. For example, the three elevators are arranged adjacent to each other in the building 13 with offices, and thus permit simultaneously parallel transportation of persons/goods. This presented embodiment of a means of transportation is exemplary. However, with knowledge of the present invention, a person skilled in the art can also use other means of transportation such as moving walks, conveyor belts, doors, as well as railroads, underground railroads, streetcars, cable cars, aircraft, etc. For example, the means of transportation is a door, which is opened according to a command signal of the control device, to give a person and/or item of goods access to a room, a stairway, a corridor, etc.

Figure 3:
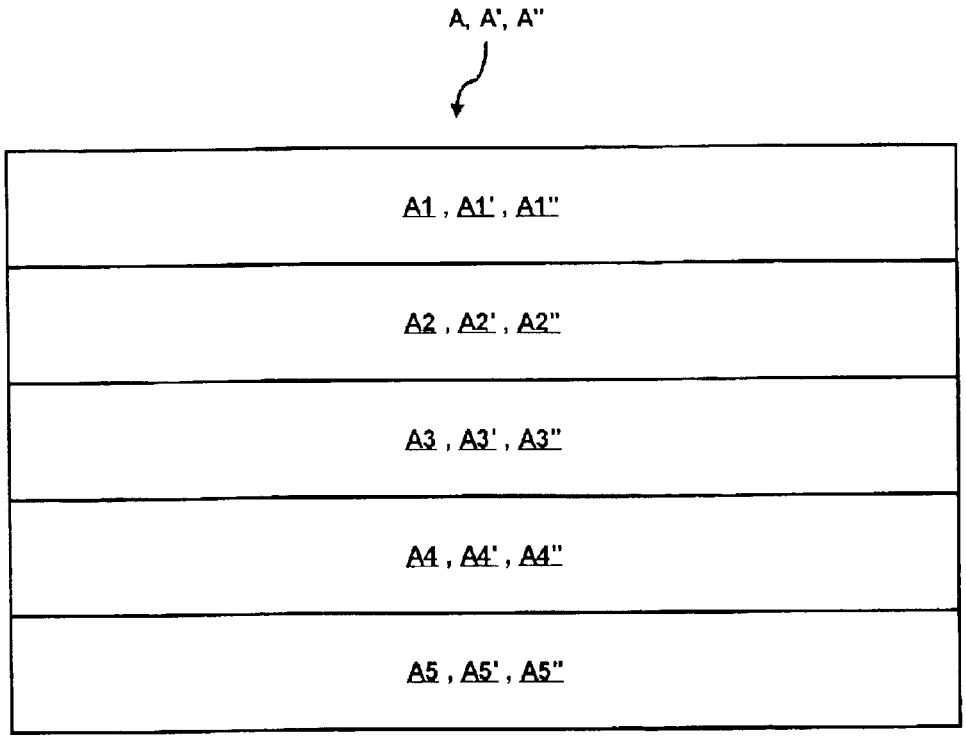
FIG. 3 is a diagram of a part of a transportation profile of the system for transportation of persons/goods shown in FIG. 1.

FIG. 3 is an exemplary embodiment of the user profile A (A', A"). Advantageously, the user profile A (A', A") has at least one spatial user profile or zone profile A1 (A1', A1"), and/or at least one temporal user profile or period profile A2 (A2', A2"), and/or at least one person/goods-specific user profile or individual profile A3 (A3', A3"), and/or at least one group-specific user profile or group profile A4 (A4', A4"), and/or at least one security-relevant user profile or security profile A5 (A5', A5").

Figure 4:
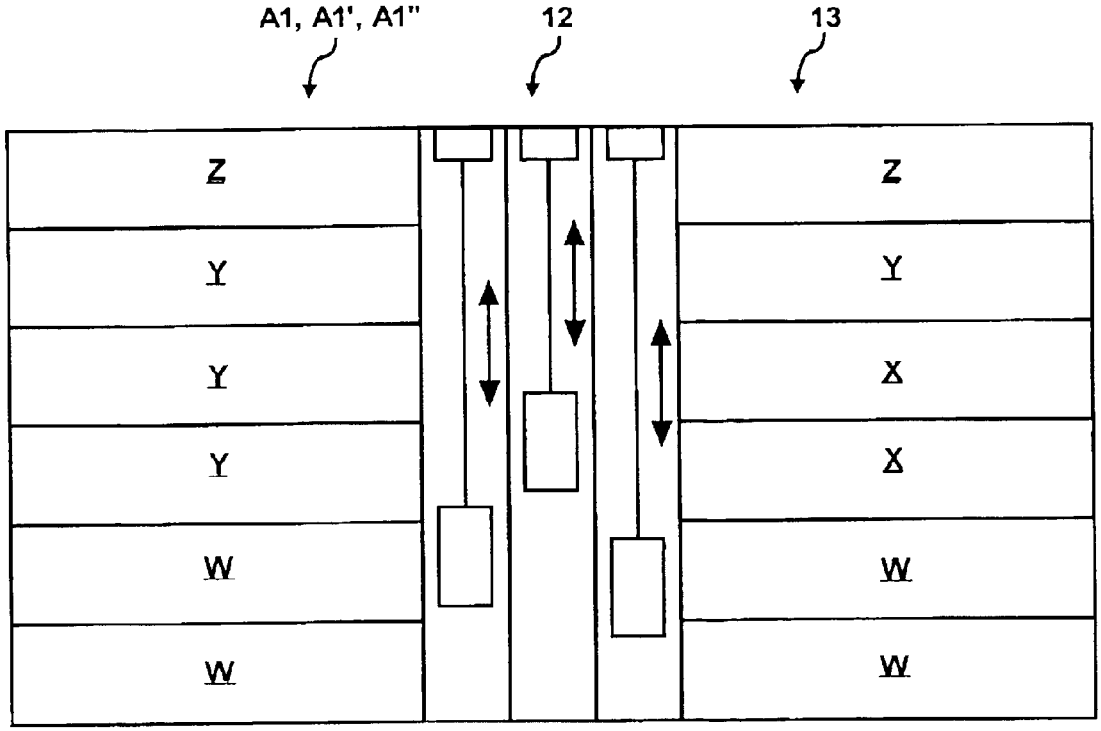
FIG. 4 is a diagram of a part of a zone profile of the system for transportation of persons/goods shown in FIG. 1.

In the zone profiles A1, A1', A1" the spatial access authorization of the user in zones is defined. Zones are to be understood as spatially related areas. The zones can be related or unrelated. An exemplary embodiment of such a zone profile A1 (A1', A1") is represented in the diagram according to FIG. 4. Visible in this diagram is the multi-story building 13 in which several elevators as the means of transportation 12 transport persons/goods. For example, the building 13 is divided into a left-hand and a right-hand half. For example, the half-stories of the building 13 are subdivided into four zones, W, X, Y, Z. For example, the zone W is a zone with low access priority, to which practically all users as well as visitors and guests have access. For example, zone W comprises the entrance/reception on the ground floor of the building 13 and a user restaurant on the first floor of the building 13. For example, zones X and Y are two zones with medium access priority, to which only users with certain privileges have access. For example, employees of companies which have offices in the half-stories of the zones X and Y have access to these zones X and Y. For example, the zone Z is a zone with high access priority, to which only users with certain privileges have access. For example, it comprises a penthouse apartment to which only the owner(s)/tenant(s) of the penthouse apartment has/have access. Zones of the same access priority need not adjoin each other. Advantageously, each zone is accessible with the means of transportation 12 of the invention. Self-evidently, with knowledge of the present invention a person skilled in the art can realize unlimited variations of a zone profile. The embodiment of a zone profile shown is exemplary and not restrictive for the scope of application and/or protection of the invention. For example, the zone profile can be subdivided even more finely, i.e. into even more than four zones. Self-evidently, it is also possible to subdivide the zone profile into fewer than four zones.

Figures 5, 6:
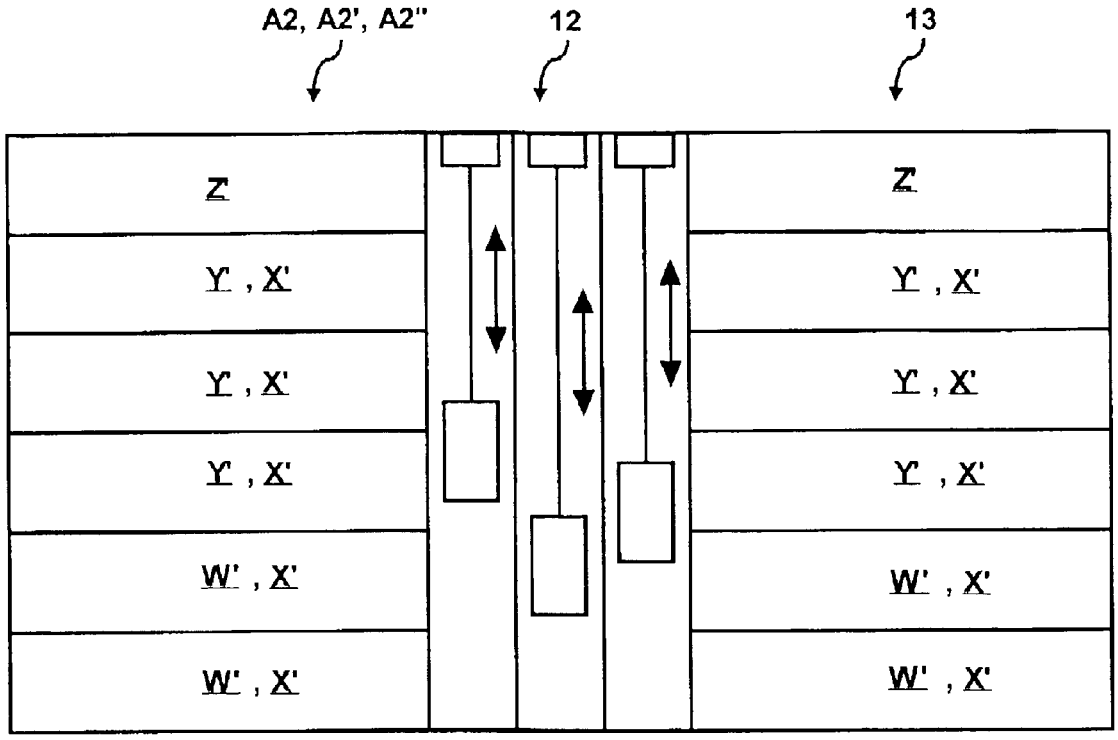
FIG. 5 is a diagram of a part of a period profile of the system for transportation of persons/goods shown in FIG. 1.
FIG. 6 is a diagram of a part of a transportation profile of the system for transportation of persons/goods shown in FIG. 1.

In the period profiles A2, A2', A2" the temporal rights of the user in periods are defined. Periods are to be understood as temporally related areas. The periods can be of regular length or of irregular length. An exemplary embodiment of such a period profile A2 (A2', A2") is represented in the diagram according to FIG. 5. In this embodiment the temporal rights are temporal rights according to periods W', X', Y', Z'. FIG. 5 shows the multi-story building 13 in which several elevators as the means of transportation 12 transport persons/goods. For example, the building 13 is divided into a left-hand and a right-hand half. For example, the half-stories of the building 13 are subdivided into the four periods W', X', Y', Z'. For example, the period W' is a period with low access priority, during which practically all users as well as visitors and guests have access. For example, the period W' comprises a period from 7 a.m. to 8 p.m., during which the entrance/reception on the ground floor of the building 13 as well as a user restaurant on the first floor of the building 13 are accessible. For example, the periods X' and Y' are two periods with medium access priority, during which only users with certain privileges have access. For example, the period W' comprises a period for cleaning personnel of the entrance/reception, of the user restaurant, and of the offices in the building 13. For example, the duration of this period X' is from 9 p.m. to 12 midnight. For example, employees of companies which have offices in the half-stories of the period Y' have access to these offices during this period Y'. For example, the period Y' extends from 7 a.m. to 6 p.m. For example, the period Z' is a period with high access priority, during which only users with certain privileges have access. For example, it comprises a penthouse apartment to which only the owner(s)/tenant(s) of the penthouse apartment has/have access during the period Z' of 24 hours a day. Periods of the same access priority need not adjoin each other. Advantageously, each period is accessible with the means of transportation 12 of the invention. Self-evidently, with knowledge of the present invention a person skilled in the art can realize unlimited variations of a period profile. The embodiment of a period profile shown is exemplary and not restrictive for the scope of application and/or protection of the invention. For example, the period profile can be subdivided even more finely, i.e. into even more than four periods. Self-evidently, it is also possible to subdivide the period profile into fewer than four periods. Finally, the durations of the periods can be freely set. The period profile is also to be interpreted broadly, and not restricted to a temporal access authorization. The temporal rights can be combined, for example, with the individual profile, so as to vary preferences of the user temporally in periods (for example, pop music on Monday, classical music on Friday, etc.).

In the individual profiles A3, A3', A3", individual items of information about the user are defined. Examples of items of information of the individual profile A3 (A3', A3") are the user name, the office/floor, the building/office number, at least one telephone number, the birthday (this allows greeting of the user in the means of transportation 12 on his/her birthday), the sex, the weight (this permits more efficient utilization of the means of transportation 12), etc. However, also defined in the individual profile A3 (A3', A3") can be, for example, preferences of the user such as the type of news (for example, the weather forecast, the stock exchange, etc.) which the user does or does not wish to receive in the means of transportation 12, the type of music (for example, pop music, jazz music, classical music, etc.) which the user does or does not wish to receive in the means of transportation 12. Self-evidently, with knowledge of the present invention a person skilled in the art can realize unlimited variations of an individual profile. The described embodiments of an individual profile are exemplary and not restrictive for the scope of application and/or protection of the invention. For example, the individual profile can be refined in that news items are provided to the user in a special sequence (for example, first the weather, then the stock exchange), etc. Also defined can be that the user finds jazz music, for example, very unpleasant and wishes to be spared it.

In the group profiles A4, A4', A4" information is stored about the priority when transporting users, etc. For example, certain users of the means of transportation 12 are of special significance and importance for a company. Periods of time spent by such important users in the means of transportation 12 represent unusable time or lost time. Many such important users are, however, frequently transported in the means of transportation 12. It is therefore essential to avoid such important users losing much time in the means of transportation 12. For this reason they are transported with high priority. "High priority" means that transportation of an important user receives higher weighting than that of a standard user. For example, the control device 11 values transportation of an important user as four times the transportation of a standard user. When such an important user is recognized by means of his/her identification code 2, the control device 11 attributes to the recognized identification code 3 a physical presence of four standard users, the control device behaves as if four standard users would indicate to a recognition device 9 their wish to be transported with the means of transportation 12, in fact only one important person does this. Self-evidently, with knowledge of the present invention a person skilled in the art can realize unlimited variations of a group profile. The described embodiments of a group profile are exemplary and not restrictive for the scope of application and/or protection of the invention. For example, the group profile can be refined so as to differentiate not only between important users and standard users, but so that, for example, three or four such weightings are made.

Defined in the security profiles A5, A5', A5" are items of information about security aspects of the user such as a hazard/risk assessment (Does the person/goods item present a hazard? And if so, for which other persons/goods to be transported? Is the person/goods item exposed to hazards? And if so, what steps should be taken if an emergency occurs?). It can also be specified, for example, whether an item of goods to be transported belongs to a hazardous category, and if so, it can also be specified what steps are to be taken should an accident occur with this item of goods, it can also be specified whether the item of goods may be transported with an item of goods from another hazardous category, and if so, with which and in what quantities. For example, it can be specified whether a user to be transported suffers from asthma. And it can be specified whether, in case the user has an attack of asthma, a medication is to be taken and if so, what sort. Parts of the security profile A5 (A5', A5") and/or the entire security profile A5 (A5', A5") can be accessible via means such as, for example, a monitor and/or a loudspeaker in the transportation means 13. However, parts of the security profile A5 (A5', A5") and/or the entire security profile A5 (A5', A5") can also be made accessible to specialized and responsible personnel, for example first-aiders and/or fire fighters. The access to the security profile A5 (A5', A5") can be regulated in various ways. For example, after an alarm is triggered in the means of transportation 12, the security profile A5 (A5', A5") is automatically made partially and/or completely accessible. Self-evidently, with knowledge of the present invention a person skilled in the art can realize unlimited variations of a security profile. The described embodiments of a security profile are exemplary and not restrictive for the scope of application and/or protection of the invention.

FIG. 6 shows a diagram of a part of the transportation profile B of the system 1 for transportation of persons/goods.

This exemplary embodiment of the transportation profile B is based on, for example, three user profiles A, A', A" in the embodiment according to FIG. 3. Advantageously, each user profile A, A', A" has at least one spatial user profile or zone profile A1, A1', A1", at least one temporal user profile or period profile A2, A2', A2", at least one person/goods-specific user profile or individual profile A3, A3', A3", at least one group-specific user profile or group profile A4, A4', A4", and at least one security-relevant user profile and/or security profile A5, A5', A5".

These three user profiles A, A', A" of persons/goods to be transported are linked to at least one transportation profile B. Specifically, the linking of the user profiles A, A', A" takes place according to the rules of at least one function F. For example, the zone profiles A1, A1', A1" are linked according to at least one zone function F1. For example, the period profiles A2, A2', A2" are linked according to at least one period function F2. For example, the individual profiles A3, A3', A3" are linked according to at least one individual function F3. For example, the group profiles A4, A4', A4" are linked according to at least one group function F4. For example, the security profiles A5, A5', A5" are linked according to at least one security function F5. Advantageously, the function F is at least one logical gate such as "AND", "OR", "NOT", etc.

The result R of this linking is output, for example, as at least one zone result R1, for example as at least one period result R2, for example as at least one individual result R3, for example as at least one group result R4, for example as at least one security result R5.

There follows below a presentation of the invention based on a demonstration example. For example, several persons are recognized each by the identification code 2 of the recognition device 9 and uniquely identified by the recognized identification code 3 of the control device 10. For example, these persons are currently on a certain floor (for example, on the ground floor) of the building 13 in front of the means of transportation 12 in the form of an elevator installation. The user profiles A, A', A" of these persons are linked to the transportation profile B. For example, the result of linking the individual profiles A, A', A" of these persons according to the individual function F3 is that several of these waiting persons wish to be transported to the same floor (for example, floor 6) of the building 13. The resulting transportation profile B thereby results in the control signal 4 to the elevator installation, which control signal 4 states that the waiting persons who wish to be transported to the 6th floor are to be directed (for example, by light signals and/or acoustic signals) to a designated elevator of the elevator installation and transported as one group direct to their travel destination on the 6th floor.

Transportation in this manner according to the transportation profile B is more efficient, since the resources of the elevator installation are optimized. Transportation according to the transportation profile B is also more comfortable for the persons/goods to be transported since, for example, a designated elevator travels direct to the travel destination and does not stop on the way. Finally, transportation according to the transportation profile B allows selective prevention of undesired transportation preferences, for example in the designated elevator such news items are selectively avoided which none of the persons to be transported wishes to receive.

In this manner it is also possible for the manufacturer of the means of transportation 12 to perform not only the maintenance and servicing of the means of transportation 12, but also the maintenance, servicing, and updating of the user profiles A, A', A". This is a new service offering which enables the manufacturer of the means of transportation 12 to retain many customers. Particularly for customers such as international companies with company offices in many cities, this service offering can be helpful and purposeful. For example, a manufacturer of elevator installations can then not only maintain and service the elevator installations in correspondingly many buildings 13 and/or stories of these customers/companies, he can also maintain, service, and/or update the user profiles A, A', A" for these many buildings 13. The user profiles A, A', A" can be matched to each other and/or exchanged and/or centrally administered. For example, user profiles in all buildings/stories of a customer/company are compatible with each other. An important user is then, for example, transported as such in the means of transportation not only in a first building of a customer/company but also in another building of the customer company. This enables the efficiency of the elevator installations to be increased, since in all the buildings 13 the user profiles A, A', A" are used and/or the user profiles A, A', A" are linked to the transportation profiles B, and result in increased satisfaction of the needs of the persons/goods to be transported.

In this manner it is also possible to perform time-recording according to at least one of the user profiles A, A', A". For example, the presence of a user in at least one of the zones W, X, Y, Z of the building 13 of system 1 is recorded as zone time, i.e. as time difference between at least one entry to and leaving of the zones W, X, Y, Z. For example, a user is recognized at 8 a.m. at the entrance/reception of the building 13 via the identification code 2, the user profile A (A', A") with the zone profile A1 (A1', A1") is assigned to the recognized identification code 3, and according to the zone profile A1 (A1', A1") the user enters the zone W, X, Y or Z of the building 13. This access time to the zone W, X, Y or Z is recorded. Later, for example at 12 noon, the user leaves this zone W, X, Y or Z. The user is again recognized via the identification code 2, the user profile A (A', A") is assigned to the recognized identification code 3, and the user leaves the zone W, X, Y or Z. This time of leaving the zone W, X, Y or Z is recorded. In this way, zone times in buildings/floors of a customer/company can be listed for time recording.

This time recording takes place according to at least any one criterion of the user profile A (A', A"). For example, per time unit and per zone W, X, Y, Z the zone times of each user are recorded. Each of these user-specific zone times is multiplied by a corresponding user-specific salary-cost value to give a user-specific zone-time salary-cost value. The user-specific zone-time salary-cost values are added to give a zone salary-cost total. This enables work projects of the customer/company to be divided zone-specifically, and salary costs to be recorded zone-specifically and user-specifically per time unit. Self-evidently, with knowledge of the present invention a person skilled in the art can realize other unlimited variations not stated here of time recording based on a user profile.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating a system for transportation of users by a transportation means, each of the users being recognized by a recognition device via an associated identification code, the recognized identification code being passed from the recognition device to a control device for the transportation means, comprising the steps of:

a. making available for each recognized identification code at least one user profile for transportation of the user;

b. using the at least one user profile as a transportation profile for the user;

c. using the control device to command operation of the transportation means according to the transportation profile of one user being transported by the transportation means; or d. when another user is also being transported by the transportation means, linking the at least one user profile of the one user with the at least one user profile of the another user to form a shared transportation profile, and using the control device to command operation of the transportation means according to the shared transportation profile.

2. The method according to claim 1 wherein each of the at least one user profile has at least one of at least one spatial user profile or zone profile, at least one temporal user profile or period profile, at least one person/goods-specific user profile or individual profile, at least one group-specific user profile or group profile, and at least one security-relevant user profile or security profile.

3. The method according to claim 1 wherein the step d, is performed by using at least one logical gate to link the user profiles and form the shared transportation profile.

4. The method according to claim 1 including a step of maintaining the user profiles by at least one of matching, exchanging and centrally administering the user profiles.

5. The method according to claim 1 wherein the control device is a first control device and the transportation means is a first transportation means and including performing said steps c. and d. using a second control device to command operation of a second transportation means.

6. The method according to claim 5 wherein the first control device and the first transportation means are located in a first building and the second control device and the second transportation means are located in a second building.

7. The method according to claim 1 including a step of recording at least one of at least one time of entering and at least one time of leaving at least one zone of a building served by the transportation means.

8. The method according to claim 1 including performing said steps b., c. and d. with a computer program product.

9. A system for the transportation of persons/goods by transportation means that recognizes at least one identification code associated with a person/goods to be transported comprising:

a recognition device for recognizing a separate identification code associated each of a plurality of persons/goods; and a control device storing a user profile associated with each said recognized identification profile, said control device being responsive to each said recognized identification code for commanding operation of a transportation means according to a transportation profile formed from said associated user profile, wherein said control device links at least two of said user profiles to form a shared transportation profile for commanding operation of the transportation means.

10. The system according to claim 9 including one of an elevator installation, an escalator and a door connected to said control device as the transportation means.

11. A control device for commanding a system for the transportation of persons/goods which system includes at least one recognition device that recognizes at least one identification code of a person/goods for transportation and generates a recognized identification code, comprising;

a memory means for storing at least one user profile associated with each recognized identification code; and a processor means responsive to each of said user profiles for commanding operation of a transportation means according to an associated transportation profile, said processor means linking at least two user profiles to form a shared transportation profile for commanding operation of the transportation means.

12. A computer program product for commanding a system for the transportation of persons/goods which system includes at least one recognition device that recognizes at least one identification code of each person/goods item for transportation and a recognized identification code, comprising:

a means for obtaining at least one user profile from a memory for each recognized identification code; and a means responsive to the at least one user profiles for commanding operation of a transportation means according to a transportation profile, and linking at least two of the at least one user profiles to form a shared transportation profile and commanding operation of the transportation means according to said shared transportation profile.

13. The computer program product according to claim 12 including one of a control device for commanding the transportation means and a separate computer for executing the computer program product.

* * * * *